US008786431B2

(12) United States Patent
Athalye et al.

(10) Patent No.: US 8,786,431 B2
(45) Date of Patent: Jul. 22, 2014

(54) TUNABLE LOOP-DIPOLE RFID TAG ANTENNA FOR DENTURES

(76) Inventors: Akshay Athalye, Port Jefferson Station, NY (US); Branko Mrdakovic, Belgrade (RS); Branko Kolundzija, Belgrade (RS)

( * ) Notice: Subject to any disclaimer, the term of this patent is extended or adjusted under 35 U.S.C. 154(b) by 242 days.

(21) Appl. No.: 13/341,900

(22) Filed: Dec. 30, 2011

(65) Prior Publication Data

US 2012/0176240 A1 Jul. 12, 2012

Related U.S. Application Data

(60) Provisional application No. 61/460,305, filed on Jan. 3, 2011.

(51) Int. Cl.
*G08B 1/08* (2006.01)

(52) U.S. Cl.
USPC ..... 340/539.32; 340/572.1; 340/539.12; 340/5.81

(58) Field of Classification Search
USPC ..... 340/539.32, 572.1, 539.12, 5.81, 10.1, 340/571, 8.1; 235/492, 435
See application file for complete search history.

(56) References Cited

U.S. PATENT DOCUMENTS

| | | | | |
|---|---|---|---|---|
| 6,447,294 | B1 * | 9/2002 | Price | 433/167 |
| 6,693,537 | B2 * | 2/2004 | Frank | 340/568.1 |
| 2008/0079582 | A1 * | 4/2008 | Alexis et al. | 340/572.1 |
| 2010/0238042 | A1 * | 9/2010 | Paul | 340/686.6 |

* cited by examiner

*Primary Examiner* — Toan N Pham
(74) *Attorney, Agent, or Firm* — Cozen O'Connor

(57) ABSTRACT

A radio frequency identification (RFID) transponder for use in dentures is provided. The RFID transponder includes a passive RFID microchip configured for storing information related to a denture and a loop dipole antenna configured for sending the information in response to receiving a signal from an RFID reader. The loop dipole antenna in turn includes a wire forming a loop structure and a set of dipole arms going out from the loop structure. Each end of the set of dipole arms is folded at least once to form at least one meander and the dipole arms follow a shape of the denture. The RFID transponder also includes at least one tuning patch configured for tuning input impedance of the loop dipole antenna. The RFID transponder is embedded in the denture and the passive RFID microchip is electrically coupled to the loop structure.

17 Claims, 8 Drawing Sheets

500A

100

200

500B

500A

600B

600A

700A

700B

TUNABLE LOOP-DIPOLE RFID TAG ANTENNA FOR DENTURES

CROSS-REFERENCE TO RELATED APPLICATIONS

This application claims the benefit under 35 U.S.C. §119 (e) of U.S. Provisional Application Ser. No. 61/460,305, filed on Jan. 3, 2011, which is hereby incorporated by reference herein in its entirety.

FIELD OF THE INVENTION

The present invention relates to Ultra High Frequency (UHF) Radio Frequency Identification (RFID) tag antenna that can be embedded in dentures and tuning procedures for matching the embedded antenna's input impedance to the impedance of an RFID tag microchip under varying dielectric conditions.

BACKGROUND

A typical RFID system includes readers and RFID tags. The RFID tags are attached to objects of interest and the readers are used to remotely read the information contained in the tags. Most RFID tags include an antenna connected to a microchip. The antenna is used for communication with the reader and the microchip is used for storing and processing information, modulating and demodulating a radio-frequency signal, and other specialized functions.

RFID systems can be classified based on the frequency used for communication, the power source for the microchip or the method used for conveying information from the RF tag to the reader.

Embedding RFID tags into objects, such as dentures, has several useful applications, such as automated identification, detection, and localization of the objects. For example, detection of dentures can be useful in nursing homes and other long term care facilities for, e.g., the elderly, where frequent loss or misplacement of dentures may be a serious issue. In addition to the cost of replacement, denture loss causes discomfort and deterioration of the health of the denture owners. Not only does a denture owner suffer from poor nutritional intake in the time required to receive a new denture, but he or she may also suffer from the inability to adapt to the new denture.

The problem of denture loss in long term care facilities and hospitals has been analyzed in studies/researches using data gathered from a few such facilities around the world, and these studies/researches suggested techniques, such as visual denture marking and enforcement of staff and resident behavior protocols, in order to combat the problem. Use of RFID for denture identification has also been proposed in several studies. These studies proposed the use of miniature transponders embedded in dentures or tooth implants. Similar studies also suggested the idea of placing the transponders into false teeth (mostly molars). The RFID transponders presented in most of these works are very small and have limited read ranges (e.g., 2-4 inches or shorter) and, therefore, these solutions are more suited to denture identification rather than detection of lost dentures.

U.S. Pat. No. 6,734,795 discusses an RFID system for detection of lost dentures. However, the system uses a combination of a magnetic strip for detection and a close range RFID transponder for identification, wherein a magnetic detector sounds an alarm whenever a magnetic strip embedded in a denture is brought in its vicinity. The range of detection of the system is small (i.e., around 6 to 8 inches), however, and this small range of detection falls short of making a robust and seamless detection system in practical settings. Moreover, because the magnetic strip does not enable identification, the patent also suggests the use of an alternative method, such as visual marking or close range RFID transponders, in combination with a magnetic strip, such that even if a lost denture is detected someone still has to read the visual marking (e.g., name or other markings) or read the information stored in the close range RFID transponder (e.g., using a RFID scanner) to identify the owner of the denture.

A practically viable RFID system for prevention of denture loss requires a much longer range of detection distances. For instance, because lost dentures in many situations may be immersed in or surrounded by high dielectric constant materials, such as water, such RFID system should be able to provide sufficiently long reading range under such varying conditions. Existing RFID tags with long reading range requires relatively bulky antenna or separate power source and thus may not be suitable for being embedded in dentures due to their dimensions, shape and/or substrate. Moreover, these tags are often designed for external attachment to objects and hence their uses are limited for operations in free space. Therefore, even if such tags could be somehow embedded in the dentures, the impedance properties would change due to dielectric effects of the denture material and hence the tag antenna would no longer be tuned to the RFID chip to which the antenna is connected. As a result, the existing commercial off-the-shelf RFID tags may not be suitable for a viable solution to this problem, absent a proper tuning

SUMMARY

The present invention describes a loop-dipole antenna and tuning procedure. The antenna is connected to an RFID tag microchip that can operate in the UHF frequency range and the combined structure of the antenna and the microchip is embedded into a denture, forming a denture-embedded RFID tag. The information contained in the microchip can be read by a UHF RFID reader at long rages in various environments.

In one embodiment, a radio frequency identification (RFID) transponder for use in dentures is provided. The RFID transponder includes a passive RFID microchip configured for storing information related to a denture and a loop dipole antenna configured for sending the information in response to receiving a signal from an RFID reader. The loop dipole antenna in turn includes a wire forming a loop structure and a set of dipole arms going out from the loop structure. Each end of the set of dipole arms is folded at least once to form at least one meander and the dipole arms follow a shape of the denture. The RFID transponder also includes at least one tuning patch configured for tuning input impedance of the loop dipole antenna. The RFID transponder is embedded in the denture and the passive RFID microchip is electrically coupled to the loop structure.

In another embodiment, a radio frequency identification (RFID) system for detecting and identifying lost dentures in a facility is provided. The RFID system includes at least one reader deployed in fixed locations in a facility and configured for transmitting a first signal and detecting from a distance of at least one feet a second signal transmitted from an RFID transponder embedded in a denture in response to receiving the first signal. The RFID system also includes a first server located within the facility and configured for communicating with the at least one reader over a network in the facility and for controlling operations of the at least one reader. The at least one reader sends an alert to the first server when it detects the second signal from the RFID transponder.

In yet another embodiment, a method of detecting and identifying lost denture in a facility is provided. The method includes transmitting a first signal at a reader deployed in a fixed location in a facility, detecting from a distance of at least one feet a second signal transmitted from an RFID transponder embedded in a denture in response to the first signal, and sending over a network in the facility an alert to a first server located within the facility in response to detecting the second signal from the RFID transponder.

DETAILED DESCRIPTION

Figure 1:
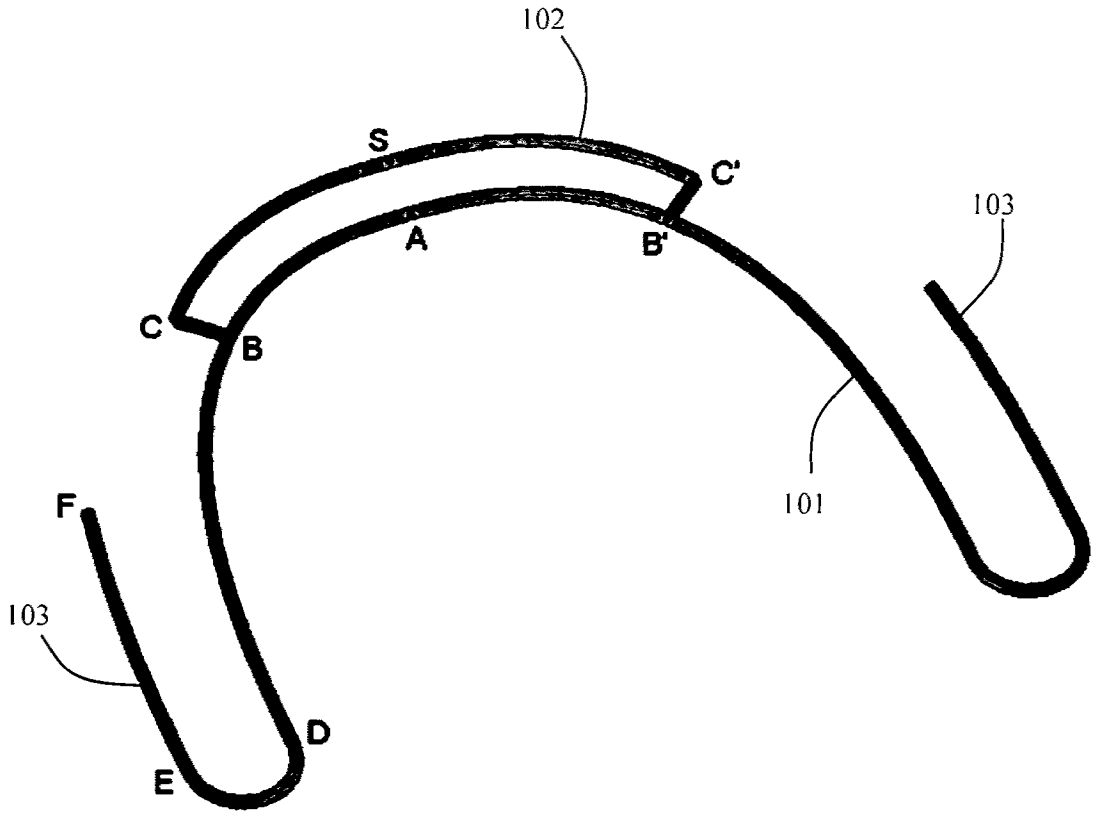
FIG. 1 illustrates a structure of a loop-dipole antenna in accordance with one embodiment of the present invention.

Loop-dipole antenna and tuning procedures are provided. The loop-dipole antenna is connected to an RFID tag microchip that can operate in the UHF frequency range and the combined structure of the antenna and the microchip can be embedded in a denture, forming a denture-embedded RFID tag.

In one embodiment, a passive RFID tag microchip is used. Passive RFID tag microchips can operate by harvesting the RF energy transmitted by an RFID reader and as a result, most passive RFID tag microchips exhibit conductive input impedance. In order to achieve desirable impedance matching, the input impedance of the loop-dipole tag antenna should be inductive.

The antenna dimensions and form factor should be small enough to allow for efficient embedding into dentures. If an antenna is too small, however, it may be difficult to achieve the desired reading distances. Moreover, the antenna should be tuned to a tag microchip when embedded in a denture and this tuning should remain when the denture is either in free space or in the presence of dielectrics, such as water.

The present invention addresses these design goals by providing an antenna with dimensions that are small enough to enable embedding into dentures, but also large enough to obtain a high value of input resistance and hence increased efficiency (e.g., increased reading distance). In one embodiment, a horseshoe shape dipole structure is chosen for the antenna because this follows the shape of the denture, and at the same time provides a length of the embedded antenna for desired input resistance. In one embodiment, the dipole arms of the horseshoe shape antenna are folded in at least one position in order to achieve improved efficiency. Further increasing of the number of folds (also referred to as meanders) will increase the length and hence efficiency of the antenna. However, increased number of meanders accompanies increased difficulty of manufacturing and embedding of the antenna and, therefore, a design tradeoff may be involved in selecting the number of meanders for a particular denture antenna.

An inductive character of the input impedance of an antenna (e.g., a loop-dipole antenna) can be obtained by an inductive loop. The dimensions of the antenna loop may have substantial influence on the characteristics of the antenna, such as inductivity.

Dentures can be of various sizes and shapes depending upon the face and mouth structure of the owners of the dentures. In addition, different dentures can be made of materials (e.g., acrylics) of different permittivity. For example, two antennas of the same dimensions embedded into dentures of different sizes and/or made of different permittivity acrylics may exhibit different input impedances.

To address such varying nature of the input impedance, a tuning procedure is provided to achieve acceptable matching for an antenna embedded in any dentures. In one embodiment, thin metallic plates are embedded in the denture along with a loop-dipole antenna to be used as tuning patches. The tuning patches may be positioned near the ends of the dipole arms of the antenna. In one embodiment, the size of the tuning patches is varied to obtain acceptable matching input impedances as well as a desired range of tag reading distances even when the denture is immersed in or surrounded by materials of high permittivity (e.g., water).

In one embodiment, an RFID system operating in the Ultra High Frequency (UHF) range is provided. The RFID system uses one or more passive RFID microchips that can obtain power for operation from the electromagnetic field transmitted by a reader and communicate back with the reader using the principle of backscatter modulation. The RFID system utilizes a loop-dipole antenna that is coupled to the RFID microchips in order to achieve a long range of reading distances (e.g., 20 ft. in certain conditions). The input impedance of the loop-dipole antenna is also matched to the microchips. The antenna may be designed to facilitate embedding into dentures while not affecting the fit, feel, strength or durability of the denture.

In one embodiment, a tuning procedure may be used to allow the performance of the RFID system to be optimized for different denture geometries and various operating environments such as denture in wet clothes or garbage or in a bowl of water or soup. A combination of a long reading range along with one or more tag microchips that can identify the denture owner can make such design well suited for detection of lost dentures in long term care facilities and hospitals.

In one embodiment, dentures equipped with an RFID tag structure is used to store important information related to the denture owners, including basic identification information as well as the owners' medical records. For instance, in a hospital environment, an RFID reader portal could be set up at the entrance of an area, allowing for partial medical records of denture-wearing patients to be read automatically. This can be more efficient and seamless than a similar application enabled by close range tags, which would require the denture-wearing patients to remove dentures from their mouth and place them very close to a reader in order for the information in the tag microchips to be read.

FIG. 1 shows a structure of a loop-dipole antenna 100 in accordance with one embodiment of the present invention. In one embodiment, loop-dipole antenna 100 is symmetrical with a line of symmetry passing through points A and S. An RFID tag microchip may be positioned at the symmetry line of the antenna. For example, a tag microchip may be positioned at or near point A. The antenna may consist of a wire dipole 101 with the ends of its arms folded to form meanders 103. The antenna may also have a loop 102 represented by the points (B-C-S-C'-B'). Dipole 101 and loop 102 are connected at points B and B'. In one embodiment, dipole 101 and loop 102 is made of the same material. In other embodiments, dipole 101 and loop 102 may be made of different materials.

In one embodiment, the shape of the wire between points B and B' is quasi-elliptical. The wire between points C and C' may be also quasi-elliptical and have a shape that is similar to shape of the wire between points B and B'. In some embodiments, the wire between points B and C and points B' and C' can form a shape other than a straight line. The wire between points B and D may be quasi-elliptical. The wire between points E and F may be parallel or almost parallel to the wire between points B and D. In one embodiment, the wire between points D and E may have a circular or quasi-elliptical shape, but in other embodiments the same wire can also be the shape of a straight line.

Figure 2:
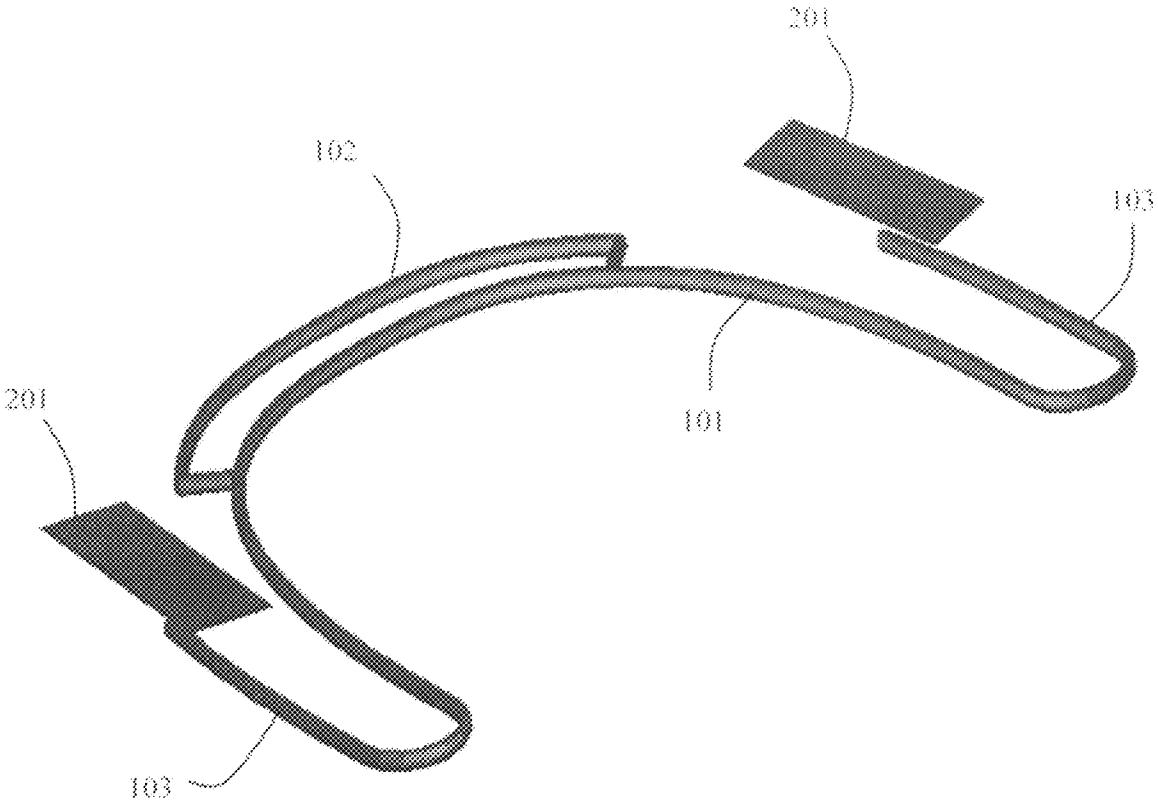
FIG. 2 illustrates a combined structure of a loop-dipole antenna and a set of metallic tuning patches in accordance with one embodiment of the present invention.

FIG. 2 shows a combined structure 200 of loop-dipole antenna 100 and a set of metallic tuning patches 201 in accordance with one embodiment of the present invention. In one embodiment, tuning patches 201 are symmetrically positioned. In one embodiment, tuning patches 201 are positioned above the ends of dipole arms. Tuning patches 201 can be of an arbitrary shape, including the shape of an elongated rectangle. In one embodiment, tuning patches 201 are positioned near a surface of the denture and covered with a thin layer of denture material.

In practice, each denture is of a different shape and size and is made of different materials having a wide range of different permittivity. In one embodiment, the real part of the permittivity of the denture materials can range from about 2.2 to about 3.5 whereas the imaginary part of the permittivity may range from about 0.02 to about 0.04.

Dentures having an embedded loop-dipole antenna can be placed in many different surroundings. If such a denture is placed in a glass of water, for example, the effective permittivity of the denture can change dramatically, causing a change in the antenna input impedance. Therefore, it is desired that the antenna be designed such that sufficient tag detection range in different surroundings. A tuning procedure is provided in order to obtain desired performance for varying dimensions and varying dielectric properties of materials used in fabrication of the dentures.

Figure 3:
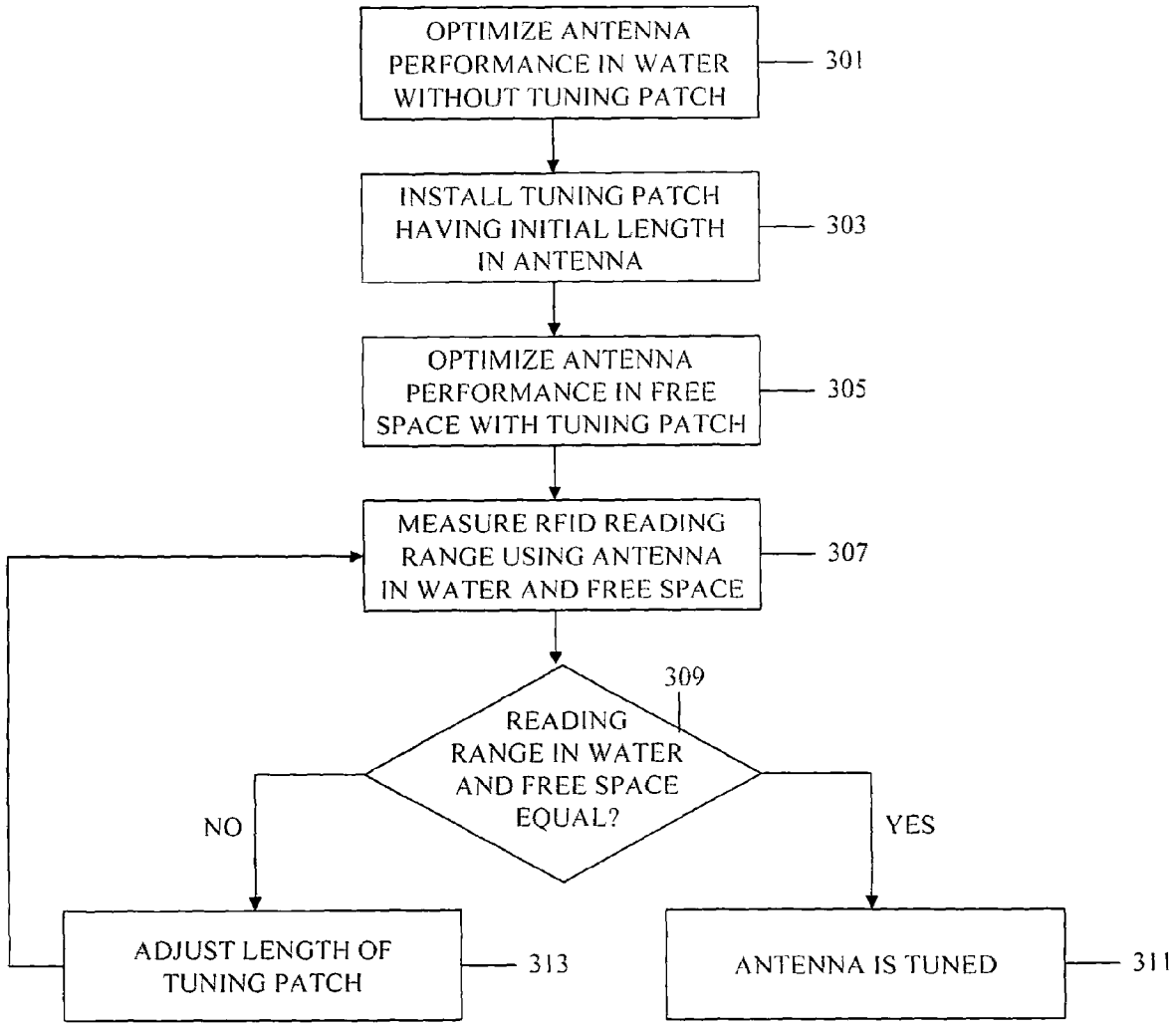
FIG. 3 is a flow diagram showing a loop-dipole antenna tuning procedure in accordance with one embodiment of the present invention.

FIG. 3 is a flow diagram showing a loop-dipole antenna tuning procedure 300 in accordance with one embodiment of the present invention. At 301, a loop-dipole antenna, such as antenna 100, embedded in a denture is optimized for performance in water before one or more tuning patches are coupled to the antenna. For example, the dimension of the antenna may be chosen so as to enable maximum reading distance when the denture is immersed in a glass of water (maximum reading distance is greater when denture is in water than when it is in free space). In one embodiment, the denture is made of a material having a relative permittivity of about 3.5.

At 303, one or more tuning patches, such as tuning patches 201, having an initial length are installed in the denture along with the loop-dipole antenna. At 305, the antenna coupled to the tuning patches is optimized for performance in free space (e.g., in air). For example, the length of the tuning patches may be chosen such that the antenna with tuning patches can achieve a maximum reading distance in free space (maximum reading distance of denture with tuning patches is greater when in free space rather than in water). In one embodiment, the tuning patches are made of a material having a relative permittivity of about 2.2. At 307, a detection range is measured for the antenna with the tuning patches both in free space and in water.

At 309, the maximum detection distance is measured for the patched antenna in free space and is compared to the maximum detection distance measured in water to determine whether the maximum distances are equal. If the distances are determined to be equal at 309, the tuning is deemed to be complete (i.e., antenna is tuned) and the tuning process ends at 311. If, however, the detected ranges are determined to be unequal at 309, the length of the tuning patches are adjusted at 313 and 307 and 309 are repeated until the antenna is tuned.

Figure 4:
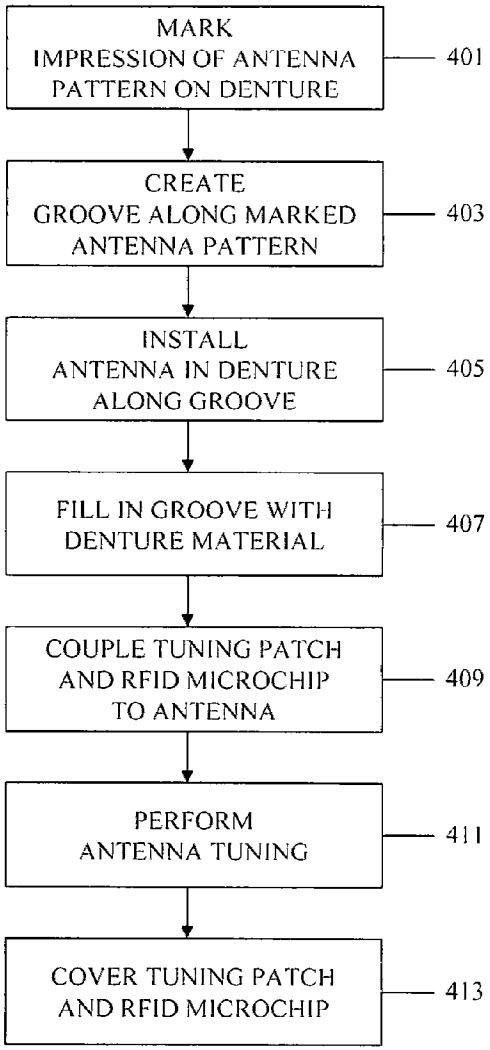
FIG. 4 is a flow diagram showing a process for embedding a loop-dipole antenna in a denture in accordance with one embodiment of the present invention.

FIG. 4 is a flow diagram showing a process 400 for embedding a loop-dipole antenna in accordance with one embodiment of the present invention. At 401, an antenna pattern is marked for a loop-dipole antenna on a denture. In one embodiment, the antenna pattern is marked using ink or a paper label. At 403, a groove is created for the loop-dipole antenna along the marked pattern. In one embodiment, the groove is between 0.5 mm to 1.5 mm in depth.

At 405, the loop-dipole antenna wire is placed into the groove. At 407, the groove holding the antenna wire is filled with the same material of which the denture is made. In one embodiment, the denture material is an acrylic. At 409, tuning patches are installed in or near the loop-dipole antenna. In one embodiment, if an RFID microchip has not already been coupled to the antenna, an RFID microchip is coupled to the antenna.

At 411, the antenna is tuned by following a tuning procedure, such as tuning procedure 300 shown in FIG. 3. In one embodiment, the dimensions of the tuning patches are adjusted to achieve desired tuning. At 413, the tuning patches and, if an RFID microchip has been coupled to the antenna along with the tuning patches, the RFID microchip are covered. In one embodiment, a light cure or cold cure acrylic material is used to cover the tuning patches or the tuning patches and the RFID microchip. In one embodiment, the denture including the antenna tag is polished with various finishing touches to fit the antenna tag and to restore the look and feel of the denture.

In one embodiment, the antenna can be made of a metal, or a combination of metals, of high conductivity, including copper, silver, platinum, gold or aluminum. In one embodiment, parts of the antenna, such as the loop and dipole arms, are made of thin wire having radius of between 0.1 mm and 1 mm. Increasing wire diameter improves antenna efficiency and decreases losses. On the other hand, however, using thick wire for an antenna limits the antenna's use. For some dentures, for example, the bulkiness of the antenna made of thick wire may not be suitable. In one embodiment, tuning patches are made of thin metallic plate, such as copper tape, a layer of silver paint and the like, that can enable ready variation in length of the tuning patches.

Figure 5B:
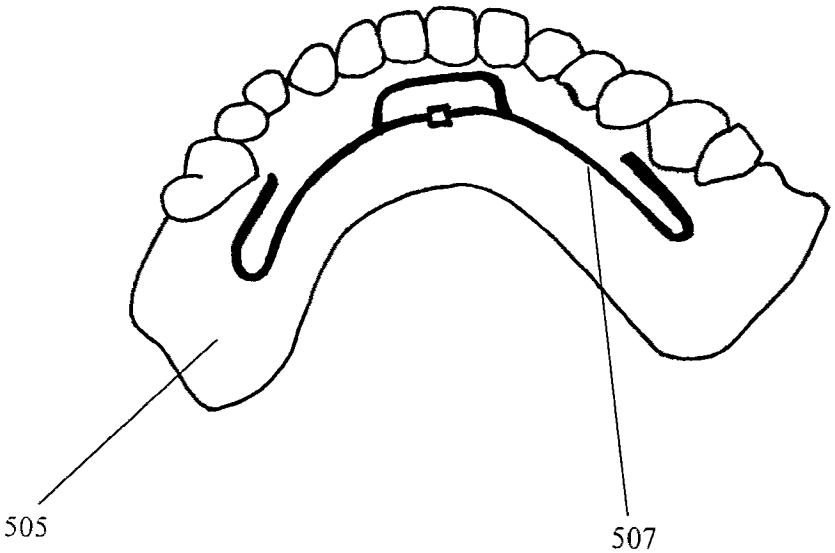
FIG. 5B shows a loop-dipole antenna embedded in a lower portion of a denture in accordance with one embodiment of the present invention.
Figure 5A:
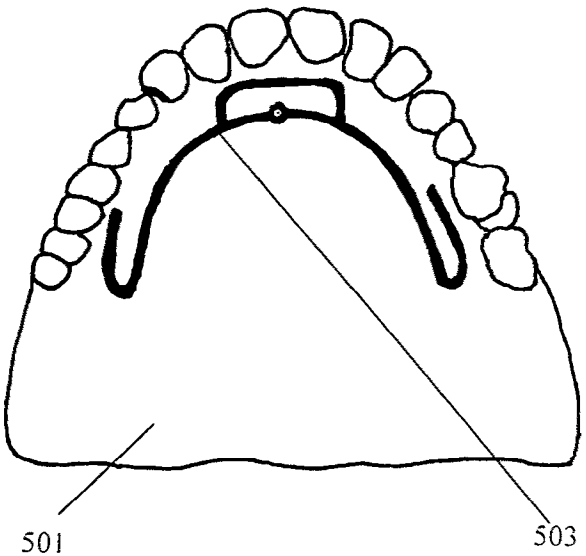
FIG. 5A shows a loop-dipole antenna embedded in an upper portion of a denture in accordance with one embodiment of the present invention.

FIG. 5A is an image showing a loop-dipole antenna 503 embedded in an upper denture (a.k.a., maxillary denture) 501 in accordance with one embodiment and FIG. 5B is an image showing a loop-dipole antenna 507 embedded in a lower denture (a.k.a., mandibular denture) 505 in accordance with one embodiment of the present invention. The images show antennas before the tuning patches are added.

Figure 6B:
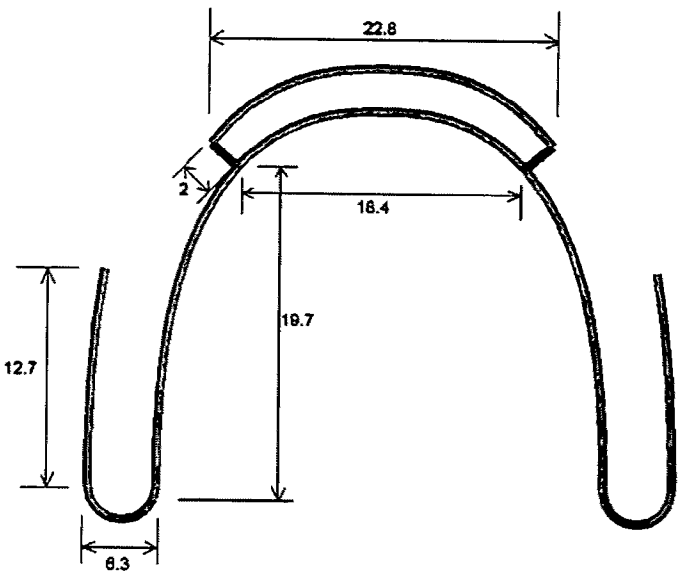
FIG. 6B shows a set of dimensions for a structure of a loop-dipole antenna including a set of wire lengths between a set of labeled points in accordance with one embodiment of the present invention.
Figure 6A:
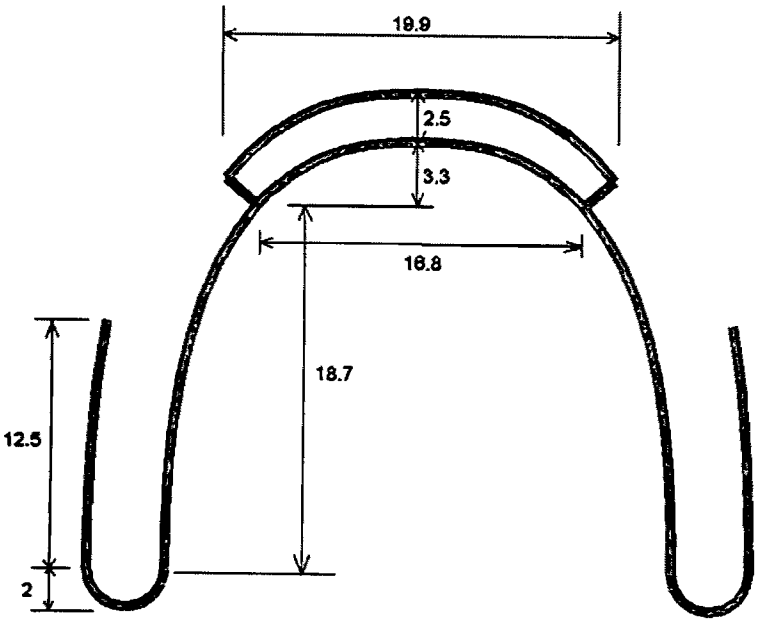
FIG. 6A shows a set of dimensions for a structure of a loop-dipole antenna including a shortest distance between a set of labeled points in accordance with one embodiment of the present invention.

FIG. 6A shows a set of dimensions for a structure of a loop-dipole antenna 600A including a shortest distance between a set of labeled points in accordance with one embodiment of the present invention. FIG. 6B shows a set of dimensions for a structure of a loop-dipole antenna 600B including a set of wire lengths between a set of labeled points in accordance with one embodiment of the present invention.

Figure 7A:
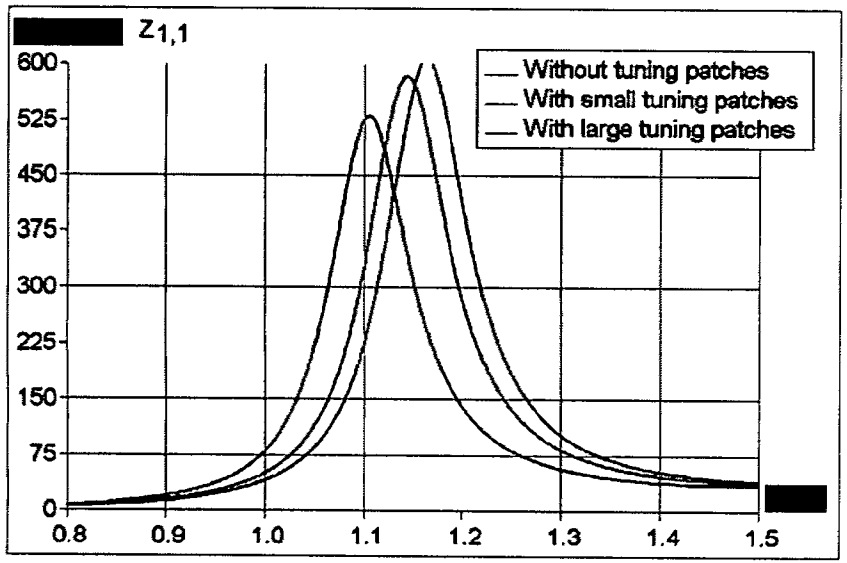
FIG. 7A illustrates a real part of an input impedance of a loop-dipole antenna with and without tuning patches in accordance with one embodiment of the present invention.
Figure 7B:
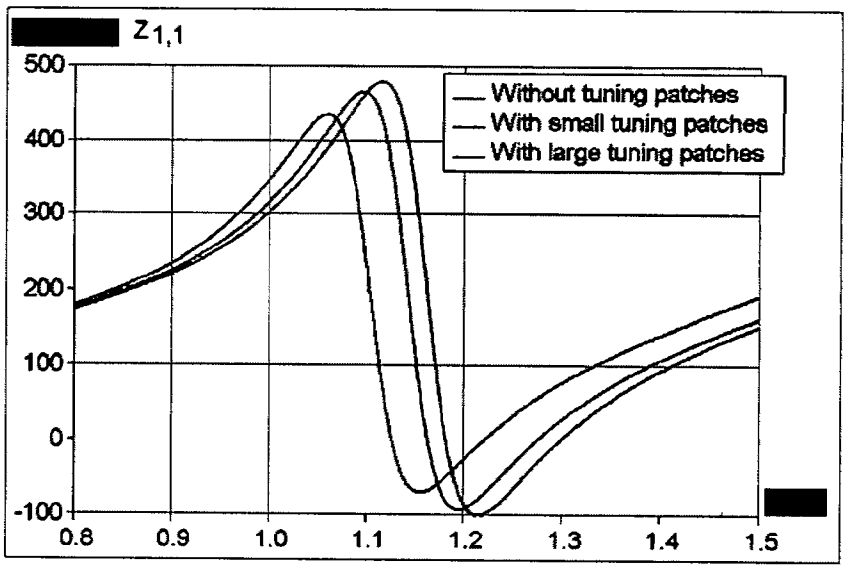
FIG. 7B illustrates an imaginary part of an input impedance of a loop-dipole antenna with and without tuning patches in accordance with one embodiment of the present invention.

FIG. 7A illustrates a real part of an input impedance of a loop-dipole antenna with tuning patches of two different sizes as well as without tuning patches in accordance with one embodiment of the present invention. FIG. 7B illustrates an imaginary part of an input impedance of a loop-dipole antenna with tuning patches of two different sizes as well as without tuning patches in accordance with one embodiment of the present invention. As illustrated in the figures, increasing the size (e.g., length) of tuning patches causes the characteristic of the antenna to move toward lower frequencies. This property is useful because it allows setting an optimal working point of the antenna by varying the size of the patches. The tuning patches can have arbitrary size and shape. In one embodiment, an elongated rectangle shape of tuning patches is used.

Dentures embedded with a long range, passive RFID tag can enable various useful applications. One such application is prevention of denture loss in nursing home, hospitals and other senior care settings. A system for preventing denture loss may include a loop-dipole antenna with RFID microchip, which is embedded in dentures, and a detection infrastructure including readers deployed throughout such facilities. In one embodiment, most common loss scenarios are identified to be used in designing a strategic detection system. Some of the loss scenarios that have been identified include dentures left on food trays after meals, dentures left in soiled linen or garbage carts, and dentures left in rooms and other common areas.

In one embodiment, a deployment infrastructure is designed based on such denture loss scenarios. The deployment infrastructure may include fixed RFID readers with multiple antennas mounted, e.g., in the hallways leading to the laundry and garbage disposal areas as well as in the food tray breakdown area (also referred to as "choke points"). In one embodiment, a handheld RFID reader may be also used in addition to the fixed RFID readers in these choke points for scanning lost dentures in residential living spaces.

The RFID tag with a loop-dipole antenna that is embedded in a denture can both detect and identify the denture if it is lost. In one embodiment, the identification information corresponding to the owner of a denture is programmed into a tag RFID microchip after the denture is retrofitted with the RFID tag with a loop-dipole antenna. In one embodiment, a denture loss prevention system includes a registration reader. A registration reader is an RFID reader that can be used for programming identification information into the tagged dentures.

Figure 8:
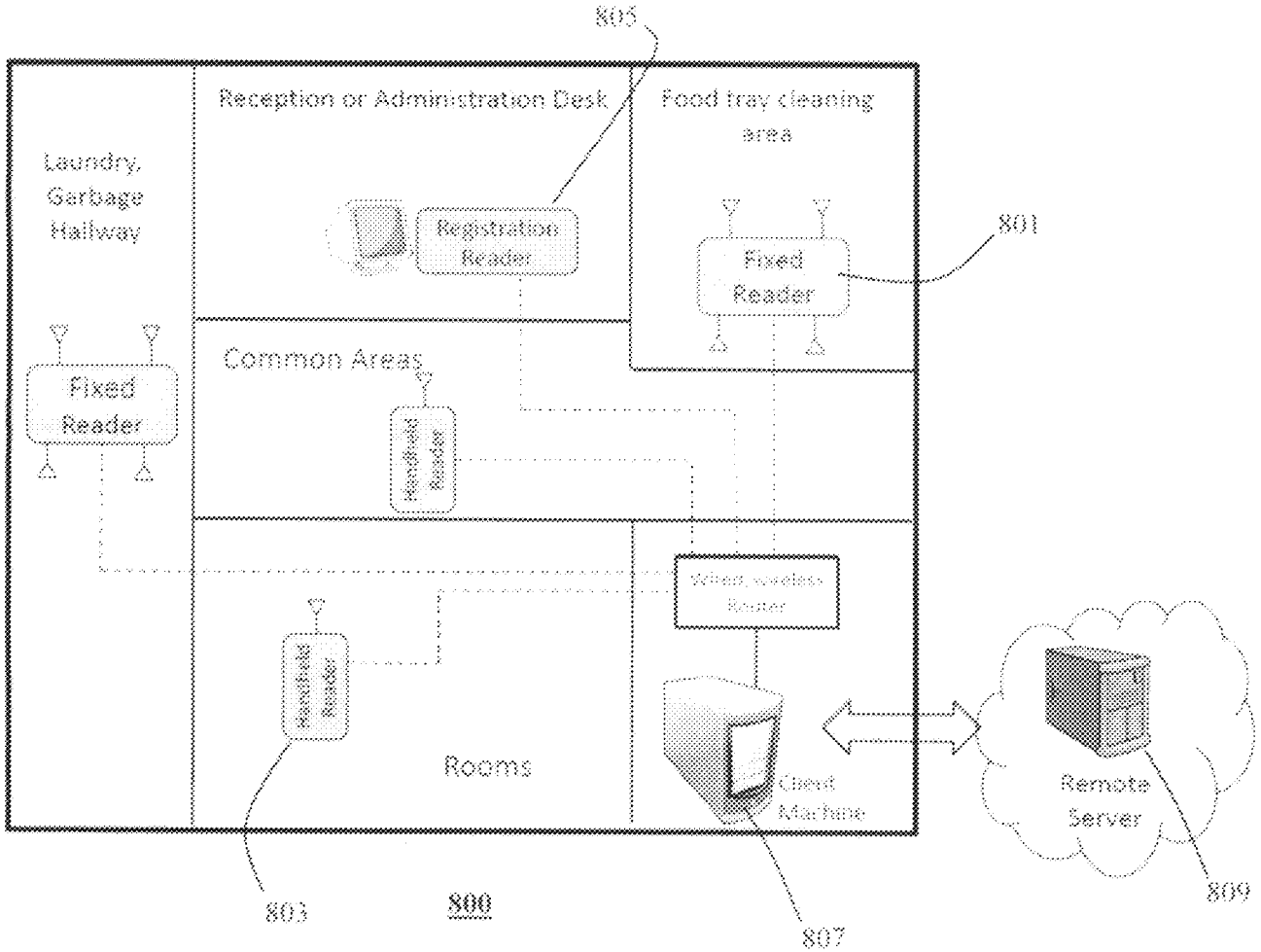
FIG. 8 is a diagram illustrating an RFID system that can be used in nursing homes and hospitals in accordance with one embodiment of the present invention.

FIG. 8 is a diagram illustrating an RFID system 800 that can be used in nursing homes and hospitals in accordance with one embodiment of the present invention. RFID system 800 includes fixed readers 801 deployed at strategic choke points, handheld readers 803 for scanning other areas of the facility and a registration reader 805 for programming identification information into a tagged denture. All the readers (fixed readers 801, handheld reader 805, and registration reader 805) can communicate over a network in the facility with a client machine 807 that is deployed internally within the facility network. Client machine 807 runs all the programs to control the operation of the readers within the facility and also interacts with an external remote server 809. Remote server 809 hosts a web application and a database that allows users to access and control the system deployed within the facility simply by using a web browser on their computers or mobile devices.

In one embodiment, each choke point is equipped with an audible and visual alarm. Whenever the fixed reader at the choke point detects a tagged denture passing thru it, these alarms can be set off. In addition to these localized alarms, the information about the detection is conveyed to client machine 807 and in turn to remote server 809. Remote server 809 runs an alerting mechanism whereby emails, text messages, pager messages or voice messages can be sent instantly to designated personnel, thereby the system provides both local alerts as well as alerts for personnel who may or may not be off site.

What is claimed is:

1. A radio frequency identification (RFID) transponder for use in dentures, comprising:

a passive RFID microchip configured for storing information related to a denture;

a loop dipole antenna configured for sending the information in response to receiving a signal from an RFID reader, the loop dipole antenna including:

a wire forming a loop structure; and a set of dipole arms going out from the loop structure, wherein each end of the set of dipole arms is folded at least once to form at least one meander and wherein the dipole arms follow a shape of the denture; and at least one tuning patch configured for tuning input impedance of the loop dipole antenna, wherein the RFID transponder is embedded in the denture, and wherein the passive RFID microchip is electrically coupled to the loop structure.

2. The RFID transponder of claim 1, wherein the information related to the denture includes an identification of the denture owner and at least one of (1) the denture owner's medical records and (2) data pertinent to the denture's lost and found history including date and time when the denture was lost and place where it was found.

3. The RFID transponder of claim 1, wherein the wire forming the loop structure and the dipole arms are made of different materials.

4. The RFID transponder of claim 1, wherein a material used to make the loop-dipole antenna includes copper, silver, gold, platinum, aluminum, or a combination thereof.

5. The RFID transponder of claim 1, wherein the loop dipole antenna has a non-planar shape that is determined by the shape of the denture.

6. The RFID transponder of claim 1, wherein the loop dipole antenna gives the denture-embedded RFID transponder a reading distance of at least 20 feet.

7. The RFID transponder of claim 1, wherein the at least one tuning patch includes a couple of tuning patches that are positioned symmetrically with respect to the loop-dipole antenna.

8. The RFID transponder of claim 1, wherein a material used to make the tuning patch includes copper, silver, gold, platinum, and aluminum.

9. A radio frequency identification (RFID) system for detecting and identifying lost dentures in a facility, comprising:

at least one reader deployed in fixed locations in a facility and configured for transmitting a first signal and detecting from a distance of at least one feet a second signal transmitted from an RFID transponder embedded in a denture in response to receiving the first signal;

a first server located within the facility and configured for communicating with the at least one reader over a network in the facility and for controlling operations of the at least one reader, wherein the at least one reader sends an alert to the first server when it detects the second signal from the RFID transponder and wherein the first server is further configured for sending a message when it receives the alert from the at least one reader; and a second server located outside of the facility and configured for receiving the message and for relaying the message by converting the message to at least one of an email, a text message, a pager message, and a voice message.

10. The RFID system of claim 9, further comprising at least one of an audible alarm and a visual alarm that are coupled to the at least one reader and wherein the at least one reader is further configured for setting off the alarms.

11. The RFID system of claim 9, wherein the network in the facility includes a wireless network.

12. The RFID system of claim 11, further comprising at least one portable reader configured for scanning areas outside a maximum reading distance of the at least one fixed reader by transmitting a third signal, for detecting a fourth signal transmitted from the RFID transponder in response to receiving the third signal, and for sending an alert to the first server over the wireless network in the facility when it detects the fourth signal from the RFID transponder.

13. The RFID system of claim 12, wherein the second signal and the fourth signal include information related to the denture including an identification of the denture owner and at least one of (1) the denture owner's medical records and (2) data pertinent to the denture's lost and found history including date and time when the denture was lost and place where it was found.

14. The RFID system of claim 13, wherein at least one of the first server and the second server are further configured for processing the information related to the denture, for generating a record using the processed information, and for storing the generated record.

15. A method of detecting and identifying lost denture in a facility, comprising:

transmitting a first signal at a reader deployed in a fixed location in a facility;

detecting from a distance of at least one feet a second signal transmitted from an RFID transponder embedded in a denture in response to the first signal; and sending over a network in the facility an alert to a first server located within the facility in response to detecting the second signal from the RFID transponder, wherein the second signal includes information related to the denture including an identification of the denture owner and at least one of (1) the denture owner's medical records and (2) data pertinent to the denture owner's lost and found history including data and time when the denture was lost and place where it was found.

16. The method of claim 15, further comprising setting at least one of an audible alarm and a visual alarm when the second signal is detected.

17. The method of claim 15, further comprising processing the information related to the denture and generating at least one of an email, a text message, a pager message, and a voice message based at least in part on the information related to the denture.

* * * * *